US007367696B2

(12) United States Patent
Richardson et al.

(10) Patent No.: US 7,367,696 B2
(45) Date of Patent: May 6, 2008

(54) FOLDABLE LANTERN BASE

(75) Inventors: Mary K. Richardson, Viola, KS (US); Todd W. Showalter, Derby, KS (US); Duane Marshall, Wichita, KS (US); Vernon J. Taylor, Wichita, KS (US); Timothy M. Holub, Cheney, KS (US)

(73) Assignee: The Coleman Company, Inc., Wichita, KS (US)

( * ) Notice: Subject to any disclaimer, the term of this patent is extended or adjusted under 35 U.S.C. 154(b) by 312 days.

(21) Appl. No.: 11/156,930

(22) Filed: Jun. 20, 2005

(65) Prior Publication Data

US 2005/0286254 A1 Dec. 29, 2005

Related U.S. Application Data

(60) Provisional application No. 60/583,241, filed on Jun. 25, 2004.

(51) Int. Cl.
*F21V 21/06* (2006.01)
*F21V 21/26* (2006.01)
*F21L 19/00* (2006.01)

(52) U.S. Cl. ..... 362/388; 362/181; 362/413

(58) Field of Classification Search ..... 362/388, 362/159, 160, 171, 172, 178, 179, 181, 382, 362/392, 393, 410, 413, 190, 191
See application file for complete search history.

(56) References Cited

U.S. PATENT DOCUMENTS

| | | | | |
|---|---|---|---|---|
| 339,148 | A | | 4/1886 | Chvala |
| 479,207 | A | | 7/1892 | Edmond et al. |
| 889,020 | A | | 5/1908 | Kellogg |
| 1,149,004 | A | | 8/1915 | Terry |
| 1,716,967 | A | * | 6/1929 | Mains et al. ..... 362/393 |
| D163,468 | S | | 5/1951 | Millard |
| 2,655,337 | A | | 10/1953 | Diesfeld |
| 2,656,454 | A | | 10/1953 | Yacyshyn |

(Continued)

FOREIGN PATENT DOCUMENTS

| | | |
|---|---|---|
| EP | 0 588 722 A1 | 3/1994 |

(Continued)

OTHER PUBLICATIONS

"Coleman Propane Lanterns Instructions for Use" Manual, 2002, pp. 1-10; The Coleman Company, Inc., Wichita, Kansas.

(Continued)

*Primary Examiner*—Alan Cariaso
(74) *Attorney, Agent, or Firm*—Townsend and Townsend and Crew LLP

(57) ABSTRACT

A base for a lantern. The base provides a stable platform for supporting the lantern and prevents tipping of the lantern. The base may be used with fuel burning lanterns or lanterns that utilize batteries or other power sources. The base includes foldable feet. The feet fold out of a plane of the base for storage, for example, downward from the plane. The base is turned over and the feet, when folded (upward when the base is upside down), extend upward around a portion of the lantern during storage. This configuration provides convenient, compact storage of the lantern and base, so that the base may be stored with the lantern and may protect the lantern in storage.

19 Claims, 4 Drawing Sheets

U.S. PATENT DOCUMENTS

| | | | | | |
|---|---|---|---|---|---|
| 2,667,117 | A | | 1/1954 | Millard et al. | |
| 2,867,403 | A | | 1/1959 | Graf | |
| 3,415,476 | A | * | 12/1968 | McDermott | 362/190 |
| 3,473,771 | A | | 10/1969 | Newman | |
| 3,725,696 | A | | 4/1973 | Morton | |
| 3,752,108 | A | | 8/1973 | Bovenzi | |
| 3,847,286 | A | | 11/1974 | Garrett | |
| 4,138,939 | A | | 2/1979 | Feld | |
| 4,395,013 | A | | 7/1983 | Wissinger | |
| 4,520,431 | A | | 5/1985 | Fanelli et al. | |
| 4,646,213 | A | * | 2/1987 | Fanelli et al. | 362/180 |
| 4,702,690 | A | | 10/1987 | Sommers et al. | |
| 4,925,137 | A | | 5/1990 | Hastings | |
| 4,953,452 | A | | 9/1990 | Tarlow | |
| D316,505 | S | | 4/1991 | Chow | |
| 5,012,394 | A | * | 4/1991 | Woodward | 362/413 |
| 5,082,222 | A | | 1/1992 | Hsu | |
| D336,727 | S | | 6/1993 | Skerker et al. | |
| 5,292,101 | A | | 3/1994 | Henson | |
| 5,349,898 | A | | 9/1994 | Po Wo Cheung | |
| 5,613,485 | A | | 3/1997 | Covault | |
| D381,863 | S | | 8/1997 | Vineis | |
| 6,331,108 | B1 | * | 12/2001 | Stiner | 362/179 |
| D473,751 | S | | 4/2003 | Kaposi | |
| 6,616,685 | B2 | | 9/2003 | Rousseau | |
| 2002/0195528 | A1 | | 12/2002 | Overbeck | |
| 2004/0209210 | A1 | * | 10/2004 | Long | 362/179 |

FOREIGN PATENT DOCUMENTS

| | | | |
|---|---|---|---|
| JP | 1999312401 | A | 11/1999 |
| JP | 2001014903 | A | 1/2001 |

OTHER PUBLICATIONS

"Beverage Jugs", Coleman Outdoor Products Catalog, 2004, p. 53, The Coleman Company, Inc., Wichita, Kansas.

* cited by examiner

FOLDABLE LANTERN BASE

REFERENCE TO RELATED APPLICATION

This application claims the benefit of U.S. Provisional Application No. 60/583,241, filed Jun. 25, 2004, and incorporated herein by reference.

TECHNICAL FIELD OF THE INVENTION

The present invention is directed to lanterns, and more specifically to a base for a lantern.

BACKGROUND OF THE INVENTION

In general, a lantern is a portable light having a fuel source or power source. Lanterns may be used, for example, for camping, for other outdoor recreational activities, or to provide a work light in an outdoor environment.

Lanterns that burn liquid fuel or low pressure (LP) fuel are well known. Such lanterns include a burner assembly to which the fuel is delivered and one or more catalytic mantles which are mounted on the burner assembly. The fuel burns within the catalytic mantle, and the mantles incandesce and provide a bright light. The mantles are usually surrounded by a glass cylindrical globe.

More recently, lanterns that operate on batteries have become popular. For example, a lantern may utilize a rechargeable battery or one or more dry cell batteries, such as four D cell batteries. These lanterns typically use one or more fluorescent or other types of bulb.

Regardless of the type of lantern used, a stable base is needed for the lantern. This is particularly the case where a lantern may be tall, such as in models utilizing propane tanks wherein the globe is mounted over the propane tank. Such models are somewhat top-heavy, because most components for the lantern are positioned above the propane tank. The models are particularly top-heavy when the propane tank is almost empty.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with an embodiment of the invention, a base for a lantern is provided. The base provides a stable platform for supporting the lantern and prevents tipping of the lantern. The base may be used with fuel burning lanterns, lanterns that utilize batteries or other power sources, or other items that need a stable base.

In accordance with an embodiment, the base includes foldable feet. The feet fold out of a plane of the base for storage, for example, downward from the plane. In accordance with an embodiment, the base is turned over and the feet, when folded (in one embodiment, upward when the base is upside down), extend upward around a portion of the lantern during storage. This configuration provides convenient, compact storage of the lantern and base, so that the base may be stored with the lantern and may protect the lantern in storage.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
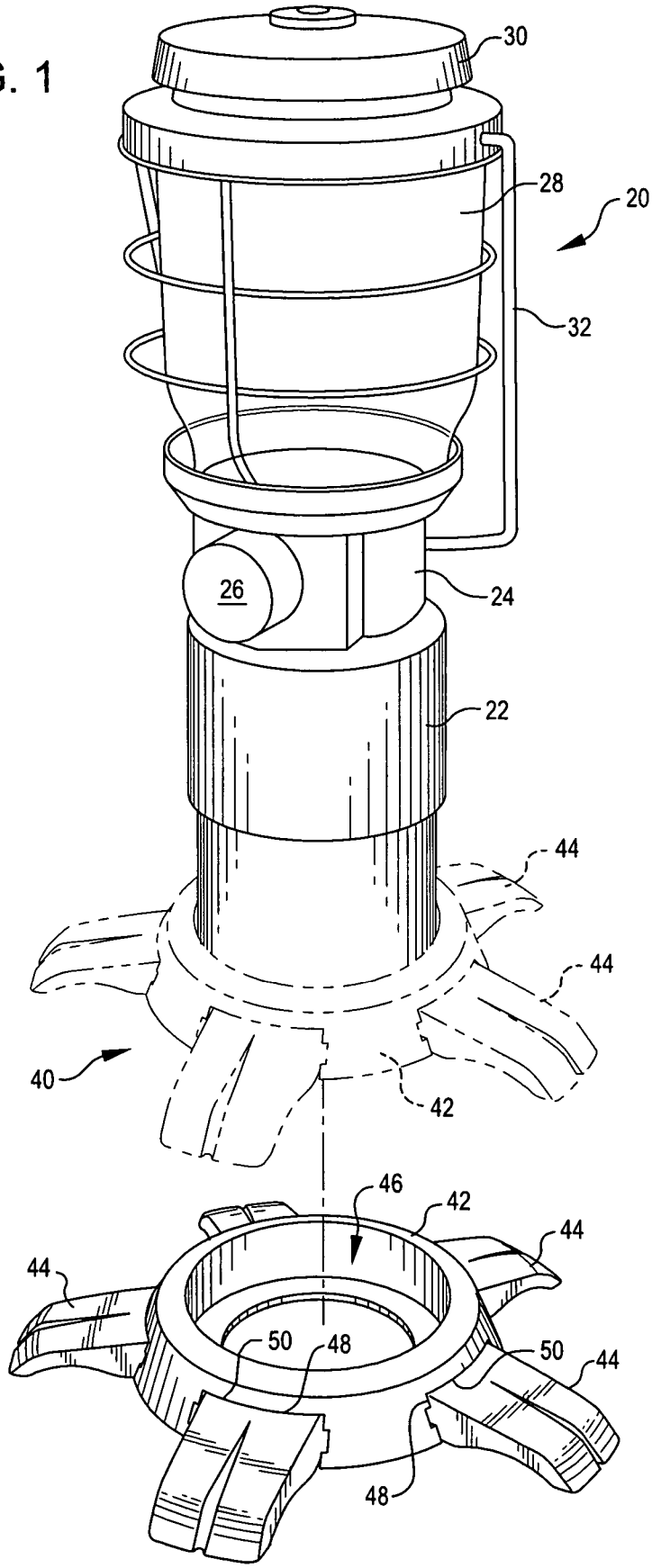
FIG. 1 is a side perspective view of a lantern incorporating a base in accordance with an embodiment of the invention.

Referring now the drawings, in which like reference numerals represent like parts throughout the several views, FIG. 1 shows a lantern 20 that may benefit from aspects of the present invention. The lantern 20 includes an LP fuel tank 22, for example, a propane fuel tank. Although the invention is described with reference to use of a fuel source (i.e., fuel from the fuel tank 22) for providing lighting for the lantern, aspects of the invention may be utilized with a lantern that uses batteries or another power or lighting source. In addition, the invention may be used with other appliances or apparatuses that need vertical support, including, but not limited to, catalytic heaters.

The lantern 20 includes a collar 24 with a fuel control knob 26 mounted thereon. A globe 28 is mounted over the collar 24. Typically, a mantle or mantles (not shown, but known in the art) are mounted within the globe and provide light for the lantern 20 in a manner known in the art. That is, fuel is provided to the mantles, and the mantles incandesce and provide a bright light. A ventilator cap 30 is mounted over the globe 28, and a bail 32 is attached to the ventilator cap.

In accordance with an embodiment, a foldable base 40 is provided for supporting the lantern 20. The foldable base 40 includes a pedestal 42 having a plurality of feet 44 attached thereto. In the embodiment shown, five feet 44 are used, but fewer or more feet may be utilized.

The pedestal 42 for the foldable base 40 is circular in configuration, but other configurations may be used. As non-limiting examples, the foldable base 40 may instead have the shape of a polygon or may be oblong. In an embodiment, the foldable base 40 is formed of plastic, but other suitable materials may be used. For example, the feet 44 may be formed of a different material than the pedestal 42, and may be provided as wire frames, as an example.

The top of the pedestal 42 includes a recess 46 that is configured and arranged to receive a bottom portion of the fuel tank 22. If alternate lanterns are supported by a foldable base, the pedestal for those lanterns may have a different configuration, such as a different sized recess or another structure, to receive a bottom portion of those lanterns. As can be understood, other lanterns may not include a fuel tank such as the fuel tank 22, or may include a fuel tank that is a different size, and thus the lantern base for those lanterns may be designed to receive a different size fuel tank, a battery or battery housing, or another portion of a lantern or other appliance structure.

The pedestal 42 includes cutouts 48 positioned around an outer circumference of the pedestal. Each of the cutouts 48 includes shoulders 50 at an upper portion.

Figure 3:
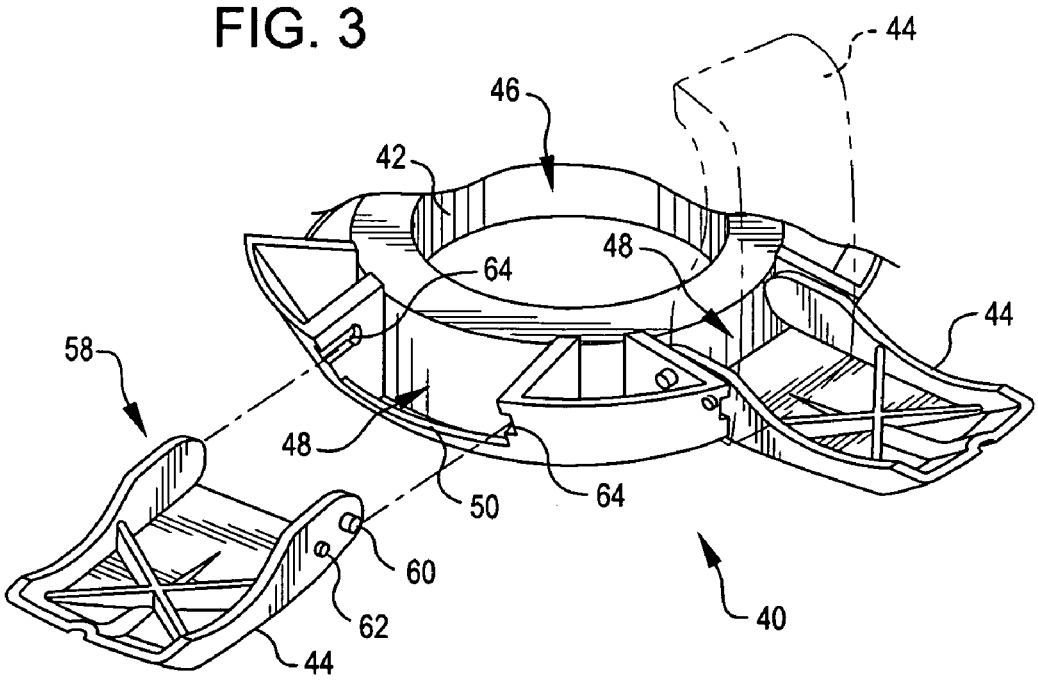
FIG. 3 is a partial-cutaway, exploded bottom perspective view of the base of FIG. 1, with a foot for the base shown removed.

As can best be seen in FIG. 3, the feet 44 each include a pivot point 58 about which the feet may be rotated. In the embodiment shown, at this pivot point 58 are positioned two pins 60 on opposite sides of the respective foot 44. Smaller protrusions 62 are positioned distally outward from the pins 60.

When the feet 44 are connected to the pedestal 42, the pins 60 each fit into one of the cutouts 48 on the pedestal 42. To this end, slots 64 (FIG. 3) are provided in the cutout 48 for receiving the pin 60. The slots 64 are slightly wider at a rear portion to receive a respective pin 60 and hold it in place. When a foot 44 is pressed into the slots 64, the pins 60 lock into the cutout 48 when the pins align with the wider rear portion. The small protrusions 62 fit into an outer portion of the cutout.

The feet 44 may fold relative to the pedestal 42 by rotation about the pins 60. When the feet 44 are in the outer position, the small protrusions 62 resist movement from this position (i.e., rotation of the feet 44) by engagement of the small protrusions with the slots 64. However, a user may apply slight force upward on the outer portions of the feet 44 (when the foldable base 40 is upside down as shown in FIG. 3) to overcome this resistance and move the small protrusions 62 out of the slots 48 so that the feet 44 may be folded relative to the pedestal 42, as is shown in phantom in FIG. 3.

The slots 64 and pins 60 connection permits different feet 44 (e.g., of different lengths) to be connected to the pedestal 42. In this manner, a manufacturer may stock a single size of pedestal 42, and multiple feet sizes, so that bases for many different applications (e.g., different lanterns) may be built using the same size pedestal.

To store the lantern 20 with the base 40, the fuel tank 22 is removed from the lantern and the base. The base 40 is then turned over, and each of the feet 44 is folded upward against the resistance of the engagement of the smaller protrusions 62 within the slots 64. With pressure by the user, the smaller protrusions 62 move out of the slots 64, and the feet 44 are rotated. In the embodiment shown in the drawings, the feet 44 are folded to a position that is perpendicular to the pedestal 42, but more or less folding may be provided.

Figure 2:
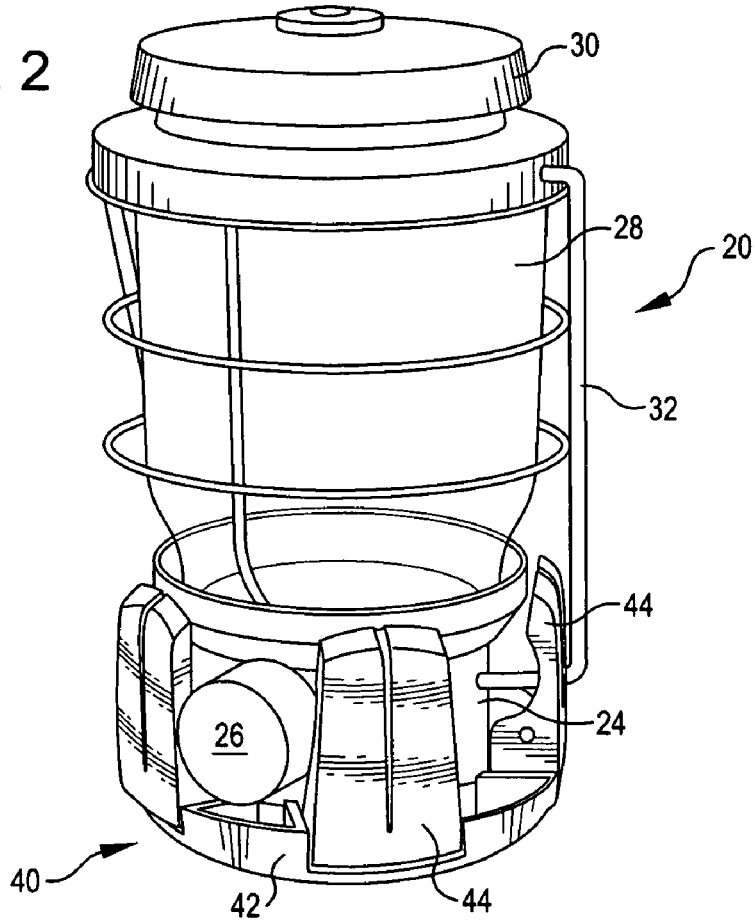
FIG. 2 is a side perspective view of the lantern and base of FIG. 1, with the base in a storage configuration.

In accordance with an embodiment, the foldable base 40 in the storage position is positioned around and underneath the collar 24, so that the pedestal 42 is located underneath the collar and the feet 44 extend upward around and against the collar. This position is shown in FIG. 2.

In accordance an embodiment, the feet 44 are arranged and positioned so that when the feet are folded upward, the fuel control knob 26 may be received between two of the feet. This feature provides more compact storage of the lantern 20.

Figure 5:
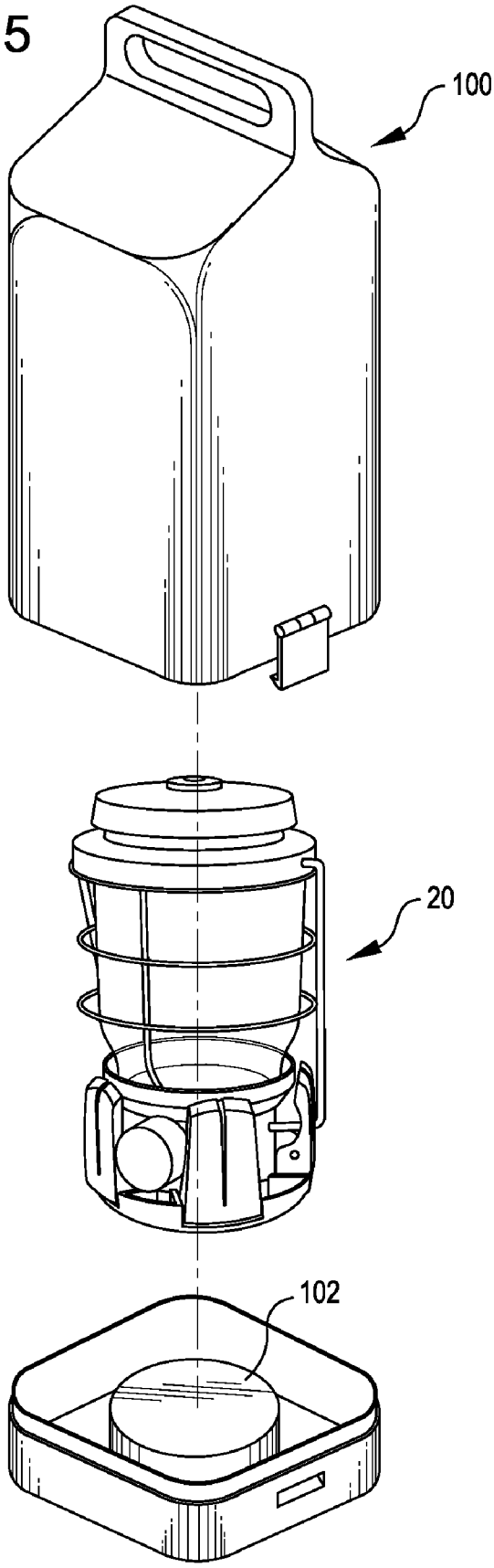
FIG. 5 is an exploded view showing the lantern and base of FIG. 2 mounted in a carrying case.

The lantern 20 and the base 40 may then be placed in a carrying case 100 (FIG. 5). If desired, the carrying case 100 may include a protrusion 102 shaped similar to the bottom of the fuel tank 22 for receiving the recess 46. The recess 46 may fit over this protrusion 102, holding the base 40 steady, so that the base provides a fixed support for the lantern. This feature provides more stable storage of the base 40 and the lantern 20. Another attachment mechanism or method for anchoring the base 40 to the carrying case 100 may be used.

In accordance with an embodiment, because the feet 44 are not stored within the pedestal 42, the feet 44 may be provided in any desired length, including lengths longer than the pedestal. As an example, the feet 44 may extend upward in the storage position to cover some of, or the entire, globe 28. In accordance with an embodiment, the feet 44 are of sufficient length to prevent most tipping of the lantern 20 when the base 40 is attached to the lantern 20. To this end, the feet 44 may be of sufficient length to prevent tipping at an angle, for example, of 20 degrees or greater. In one embodiment, when the feet 44 are extended outward from the pedestal 42, a tangent across two of the feet 44 is spaced at least 4½ inches from a center point of the pedestal 42. This spacing will change due to the height of the item being supported and weight distribution on the item.

Figure 4:
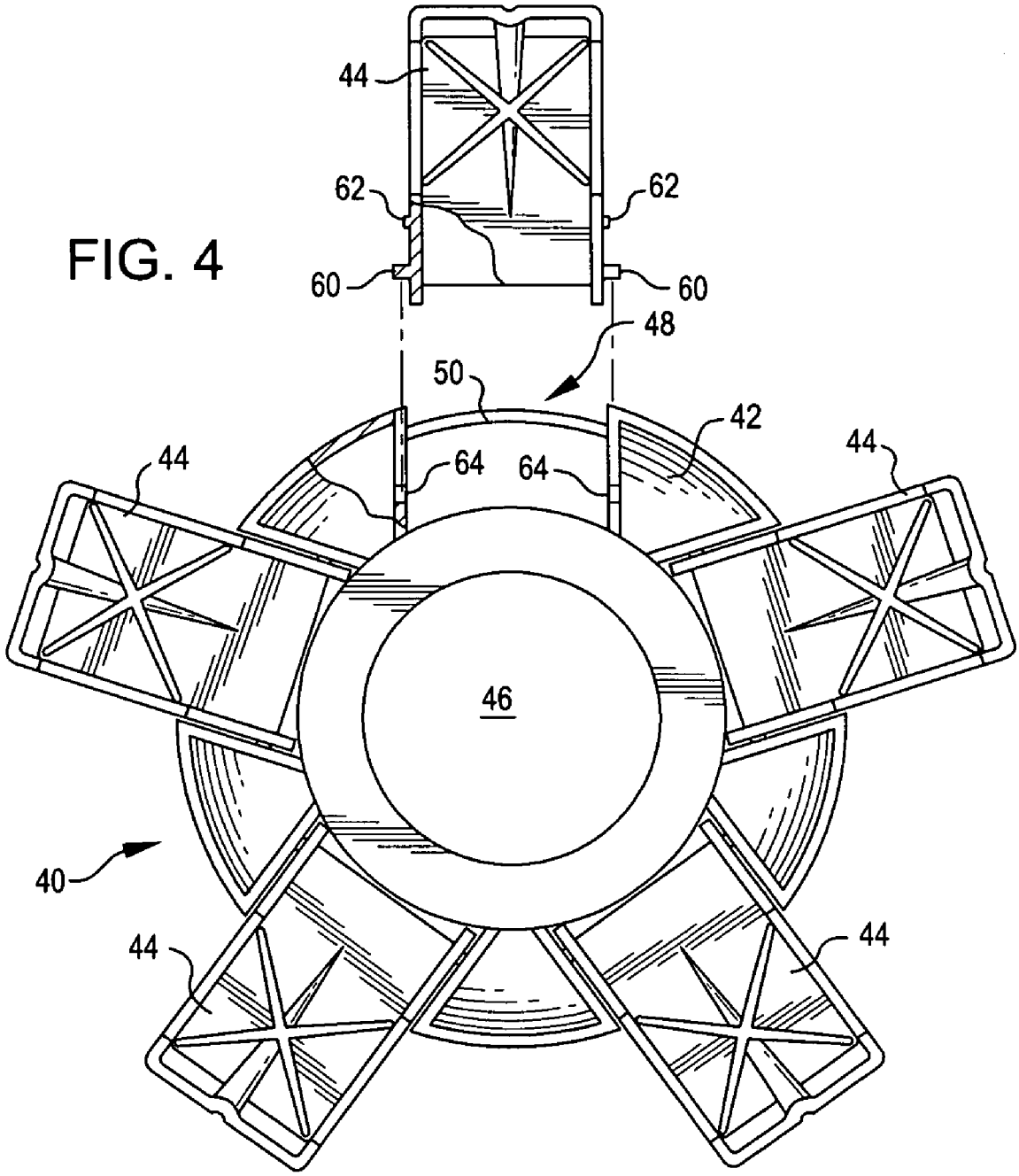
FIG. 4 is a bottom, partially-exploded view of the base of FIG. 1.

To mount the lantern 20 on the base 40, the base is removed from the bottom of the collar 24, and each of the feet 44 is folded outward to the position shown in FIG. 4. The fuel tank 22 is then threaded onto the collar 24 and is seated in the recess 46 of the pedestal 42.

When folding the feet 44 outward, the user is provided feedback on full extension of the feet by locking of the smaller protrusions 62 into the slots 64. The resistance to rotation of the feet 44 ends when the smaller protrusions 62 enter the slots 64. In addition, the shoulders 50 prevent further rotation outward of the feet 44. The shoulders 50 provide stability for the feet 44 in the outer position, thus providing a stable base for the lantern 20. The smaller protrusions 62 prevent the feet 44 from freely rotating when the base 40 is lifted, and also provide some stability for the feet 44 in the outer position.

If desired, in accordance with an embodiment of the invention, the feet 44 may be adjusted and fixed at a variety of different angles relative to the pedestal 42. A mechanism for providing such multiple adjustments is disclosed in U.S. Pat. No. 4,925,137. Other mechanisms may be provided for locking one or more of the feet 44 in a position other than the completely outward positions shown in FIG. 1. In this manner, the lantern 20 may be placed on an uneven surface, and the base 40 may be adjusted so that the lantern 20 extends upward.

In the embodiment shown, the feet 44 fold downward relative to the pedestal 42. In an alternate embodiment, the feet 44 may fold upward relative to the pedestal 42. In one such an embodiment, the shoulders 50 may be removed, and the smaller protrusions 62 may provide locking of the feet 44 in the outer positions. Other mechanisms may be used for locking the feet 44 in this outer position.

One of the cost and aesthetic advantages of the folding base 40 is that no tools are required to assemble it, and fasteners are not required to make it functional. For example, the base 40 does not utilize screws, nuts, shafts, washers, separate hinges, e-rings, springs, or other fasteners or associated hardware.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An apparatus, comprising:

a removable base comprising:

a pedestal for receiving the apparatus;

feet pivotally attached to the pedestal and foldable between a first position where the feet provide support for the pedestal and the apparatus, and a second position in which the feet fold out of a plane of the base so that the base is positionable against the apparatus and the feet in the second position extend around at least a portion of the apparatus for storage; and wherein the feet fold downward from the plane, and the base is turned over to place the feet in the second position.

2. The apparatus of claim 1, wherein the feet extend substantially perpendicular to the plane when the feet are in the second position.

3. The apparatus of claim 1, wherein the apparatus is a lantern.

4. The apparatus of claim 3, wherein the feet are spaced to receive a control knob for the lantern when in the second position.

5. The apparatus of claim 1, wherein the feet are attached to the pedestal without fasteners.

6. The apparatus of claim 1, wherein the feet are attached to the pedestal without the use of tools.

7. A lantern, comprising:

a removable base comprising:

a pedestal for receiving the lantern;

feet pivotally attached to the pedestal and foldable between a first position where the feet provide support for the pedestal and the lantern, and a second position in which the feet fold out of a plane of the base and the base is positionable against the lantern so that the feet in the second position extend around at least a portion of the lantern for storage; and wherein the feet fold downward from the plane, and the base is turned over to place the feet in the second position.

8. The lantern of claim 7, further comprising a recess in the pedestal for receiving a lower portion of the lantern when the feet are in the first position.

9. The lantern of claim 8, wherein the lower portion of the lantern is configured to attach to a fuel tank, and the fuel tank is positioned on the pedestal when the feet are in the first position.

10. The lantern of claim 9, further comprising a collar, and wherein, in the second position, the feet extend upward around the collar.

11. The lantern of claim 10, wherein the collar comprises a control knob, and wherein the control knob is received between two of the feet when the feet are in the second position.

12. The lantern of claim 9, wherein the pedestal includes a recess for receiving and supporting a fuel tank attached to the lantern when the feet are in the first position.

13. The lantern of claim 11, further comprising a carry case for the lantern, and wherein the carry case comprises a protrusion onto which the recess fits when the lantern is stored in the carry case and the feet are in the second position.

14. The lantern of claim 13, wherein the first position of at least one of the feet is adjustable.

15. The lantern of claim 7, wherein the feet extend substantially perpendicular to the plane when the feet are in the second position.

16. A lantern, comprising:

a removable base comprising:

a pedestal for receiving the lantern, the pedestal comprising a recess; and feet pivotally attached to the pedestal and foldable between a first position where the feet provide support for the pedestal and the lantern, and a second position in which the feet fold out of a plane of the base and the base is positionable against the lantern so that the feet in the second position extend around at least a portion of the lantern for storage; and a carry case for the lantern, and wherein the carry case comprises an attachment structure for connecting to the base when the lantern is stored in the carry case and the feet are in the second position, the attachment structure comprising a protrusion for fitting into the recess.

17. The lantern of claim 7, wherein the lantern comprises a globe, and wherein the feet extend around at least a portion of the globe when the feet are in the second position.

18. The lantern of claim 7, wherein the feet are attached to the pedestal without fasteners.

19. The lantern of claim 7, wherein the feet are attached to the pedestal without the use of tools.

* * * * *